US008387203B2

(12) United States Patent
Holtby

(10) Patent No.: US 8,387,203 B2
(45) Date of Patent: Mar. 5, 2013

(54) VACUUM ATTACHMENT TOOL

(75) Inventor: Quinn A. J. Holtby, Edmonton (CA)

(73) Assignee: Katch Kan Holdings Ltd. (CA)

( * ) Notice: Subject to any disclaimer, the term of this patent is extended or adjusted under 35 U.S.C. 154(b) by 379 days.

(21) Appl. No.: 12/769,482

(22) Filed: Apr. 28, 2010

(65) Prior Publication Data

US 2011/0108066 A1 May 12, 2011

Related U.S. Application Data

(60) Provisional application No. 61/173,523, filed on Apr. 28, 2009.

(51) Int. Cl.
*A47L 11/00* (2006.01)

(52) U.S. Cl. ..... 15/321; 15/322; 15/410; 134/21

(58) Field of Classification Search ..... 15/321, 15/322, 410, 415.1; 134/21; *A47L 11/00*
See application file for complete search history.

(56) References Cited

U.S. PATENT DOCUMENTS

| | | | | |
|---|---|---|---|---|
| 3,161,900 | A | 12/1964 | Hornschuch et al. | |
| 3,371,651 | A | 3/1968 | Johnson et al. | |
| 3,705,437 | A | 12/1972 | Rukavina, Jr. et al. | |
| 4,019,218 | A * | 4/1977 | Cyphert | 15/321 |
| 4,200,951 | A | 5/1980 | Burgoon et al. | |
| 4,433,451 | A | 2/1984 | Parisi | |
| 5,075,920 | A | 12/1991 | Salmon | |
| 5,088,149 | A * | 2/1992 | Berg et al. | 15/322 |
| 5,555,599 | A | 9/1996 | Markley | |
| 5,613,271 | A * | 3/1997 | Thomas | 15/321 |
| 5,706,548 | A | 1/1998 | Schabacker | |
| 5,709,548 | A * | 1/1998 | Oxman et al. | 433/218 |
| 6,263,539 | B1 * | 7/2001 | Baig | 15/322 |
| 6,598,262 | B2 | 7/2003 | Farina | |
| 6,807,708 | B2 | 10/2004 | Roney et al. | |
| 2006/0112513 | A1 * | 6/2006 | Tetteh | 15/321 |
| 2007/0113368 | A1 | 5/2007 | Alexander | |
| 2007/0151069 | A1 * | 7/2007 | Kothrade | 15/322 |
| 2008/0263812 | A1 * | 10/2008 | Williams et al. | 15/322 |

FOREIGN PATENT DOCUMENTS

| | | | |
|---|---|---|---|
| DE | 19546756 | A1 | 10/1996 |
| EP | 1027855 | A2 | 8/2000 |
| EP | 1198661 | A1 | 2/2001 |
| EP | 1720666 | A1 | 9/2005 |
| GB | 2408446 | A | 6/2005 |

* cited by examiner

*Primary Examiner* — David Redding
(74) *Attorney, Agent, or Firm* — Dinsmore & Shohl LLP

(57) ABSTRACT

A vacuum attachment tool is provided for use with one or more vacuum systems and with a source of pressurized cleaning fluid, the tool adapted for removing fluids, solids, debris and produced substances from a hydrocarbon-producing well from a surface, such as a drilling rig floor. The tool can include a brush head having a vacuum orifice, the brush head adapted for loosening fluids and solids from the surface so they can be vacuumed up through the orifice to the vacuum system. The tool can further include an orifice disposed on the brush head for dispensing pressurized cleaning fluid, and a valve mechanism for controlling the flow of the pressurized cleaning fluid.

10 Claims, 4 Drawing Sheets

VACUUM ATTACHMENT TOOL

CROSS-REFERENCE TO RELATED APPLICATIONS

This application claims priority of U.S. provisional patent application Ser. No. 61/173,523 filed Apr. 28, 2009, and hereby incorporates the same provisional application by reference herein in its entirety.

TECHNICAL FIELD

The present disclosure is related to the field of vacuum attachments for use with vacuum systems for removing fluids and solids from a surface and, in particular, vacuum attachment tools having a brush head with means for dispensing cleaning fluid on the surface to aid in loosening and removing fluids and solids from the surface.

BACKGROUND

When drilling hydrocarbon-producing wells, drilling fluid used in the drilling of the well, debris and cuttings produced during the drilling of the well ("solids") and produced substances from the well can all spill onto and accumulate on the drilling floor of a drilling rig. For the safety of the personnel working on the drilling rig floor, the spilled drilling fluid, solids and produced substances need to be cleared from the drilling rig floor. Vacuum attachment tools for residential and conventional industrial use are inadequate in design and purpose for use in removing drilling fluids, solids and produced substances from drilling rig floors.

It is, therefore, desirable to provide a vacuum attachment tool suitable for use on drilling rig floors that can connect to one or more vacuum systems that can dispense a cleaning fluid on a surface to aid in removing fluids, solids, produced substances or debris from the surface, and that comprises a brush head for loosening fluids, solids, produced substances or debris from the surface.

SUMMARY

A vacuum attachment tool is provided for use in removing fluids, solids, produced substances and debris from a work surface, such as drilling fluid containing solids or cuttings from a drilling rig floor. In one embodiment, the tool can comprise a pipe having two ends, a brush head having a vacuum orifice at one end and a vacuum coupler at the other end for attaching to a vacuum system, the vacuum orifice in communication with the vacuum coupler through the pipe. In another embodiment, the tool can comprise two or more vacuum couplers for attaching to multiple vacuum systems.

In another embodiment, the tool can comprise means for dispensing cleaning fluid from the brush head onto a surface to aid in removing fluids, solids or produced substances from the surface. For the purposes of this specification, the term "cleaning fluid" can comprise one or more of the following: water, steam, a hydrocarbon-based fluid or solvent (such as kerosene, diesel fuel or the like) or any other fluid suitable for removing drilling fluid, solids and/or hydrocarbon-based substances from a work surface such as a drilling rig floor, the choice of the suitable cleaning fluid being dependent on a number of factors, some of which can include the physical condition of the surface being cleaned; the fluids, solids and/or produced substances to be removed from the surface; and the environmental conditions during which the tool is being used, such as weather or temperature.

In one embodiment, the cleaning fluid dispensing means can comprise at least one orifice disposed on a bottom surface of the brush head, the at least one orifice in communication with a line coupler disposed on a top surface of the brush head. In yet another embodiment, the tool can further comprise means for controlling the flow of cleaning fluid to the at least one orifice. The means can comprise a handle disposed on the pipe having a trigger valve to control the flow of cleaning fluid through to the line coupler on the brush head. In another embodiment, the tool can comprise a support handle disposed on the pipe, the support handle having means to be positioned and secured at any position on the pipe.

Broadly stated, a vacuum attachment tool is provided for use with at least one vacuum system and a source of at least one pressurized cleaning fluid, comprising: a longitudinal pipe having a first vacuum coupler adapted to couple with the at least one vacuum system, the first vacuum coupler disposed at a first end of the pipe, and a brush head disposed at a second end of the pipe, the brush head comprising at least one vacuum orifice disposed on a bottom surface thereof, the pipe providing communication between the first vacuum coupler and the at least one vacuum orifice; bristles disposed on the bottom surface of the brush head; and means for dispensing at least one cleaning fluid from the brush head.

Broadly stated, a method is provided for cleaning a surface of fluids and solids, the method comprising the steps of: providing one or more vacuum systems; providing at least one source of pressurized cleaning fluid; providing a vacuum attachment tool, the tool comprising a longitudinal pipe having a first vacuum coupler adapted to couple with the vacuum system, the first vacuum coupler disposed at a first end of the pipe, and a brush head disposed at a second end of the pipe, the brush head comprising at least one vacuum orifice disposed on a bottom surface thereof, the pipe providing communication between the first vacuum coupler and the at least one vacuum orifice, bristles disposed on the bottom surface of the brush head, and means for dispensing at least one cleaning fluid from the brush head; operatively coupling the tool to the one or more vacuum systems and to the source of the at least one pressurized cleaning fluid; applying at least one cleaning fluid to the surface with the tool; and brushing the surface with the brush head whereby the fluids and solids loosened from the surface can be vacuumed through the at least one vacuum orifice to the one or more vacuum systems.

DETAILED DESCRIPTION OF EMBODIMENTS

Figure 1:
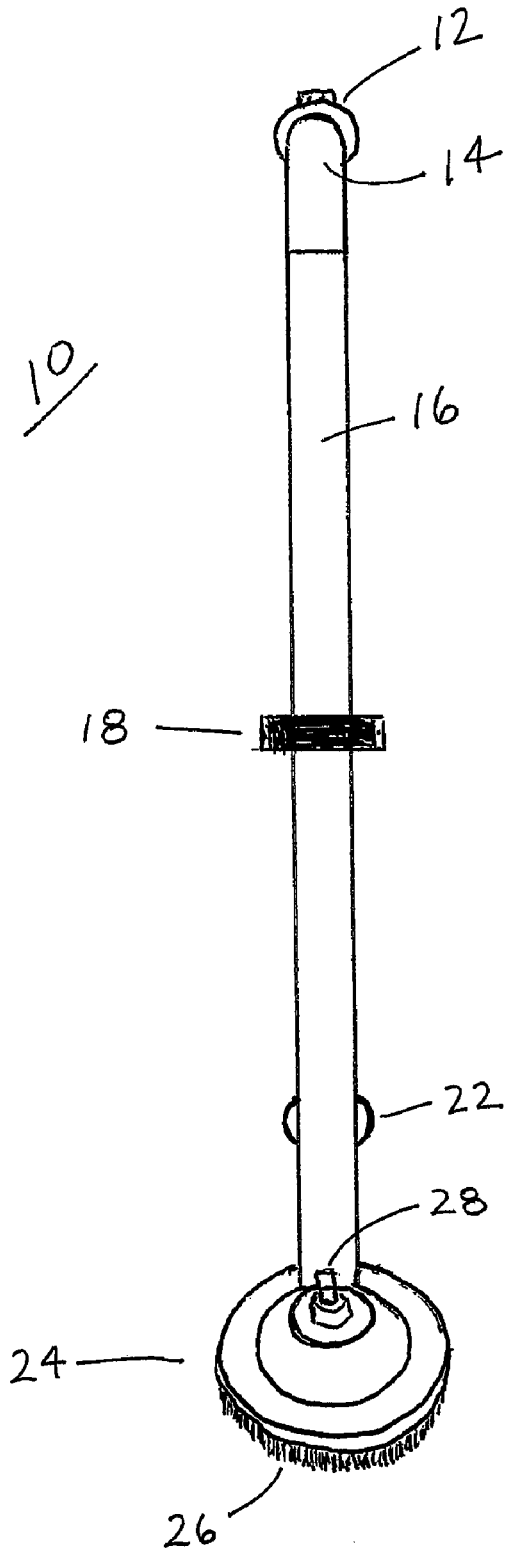
FIG. 1 is a front perspective view depicting a vacuum attachment tool.
Figure 2:
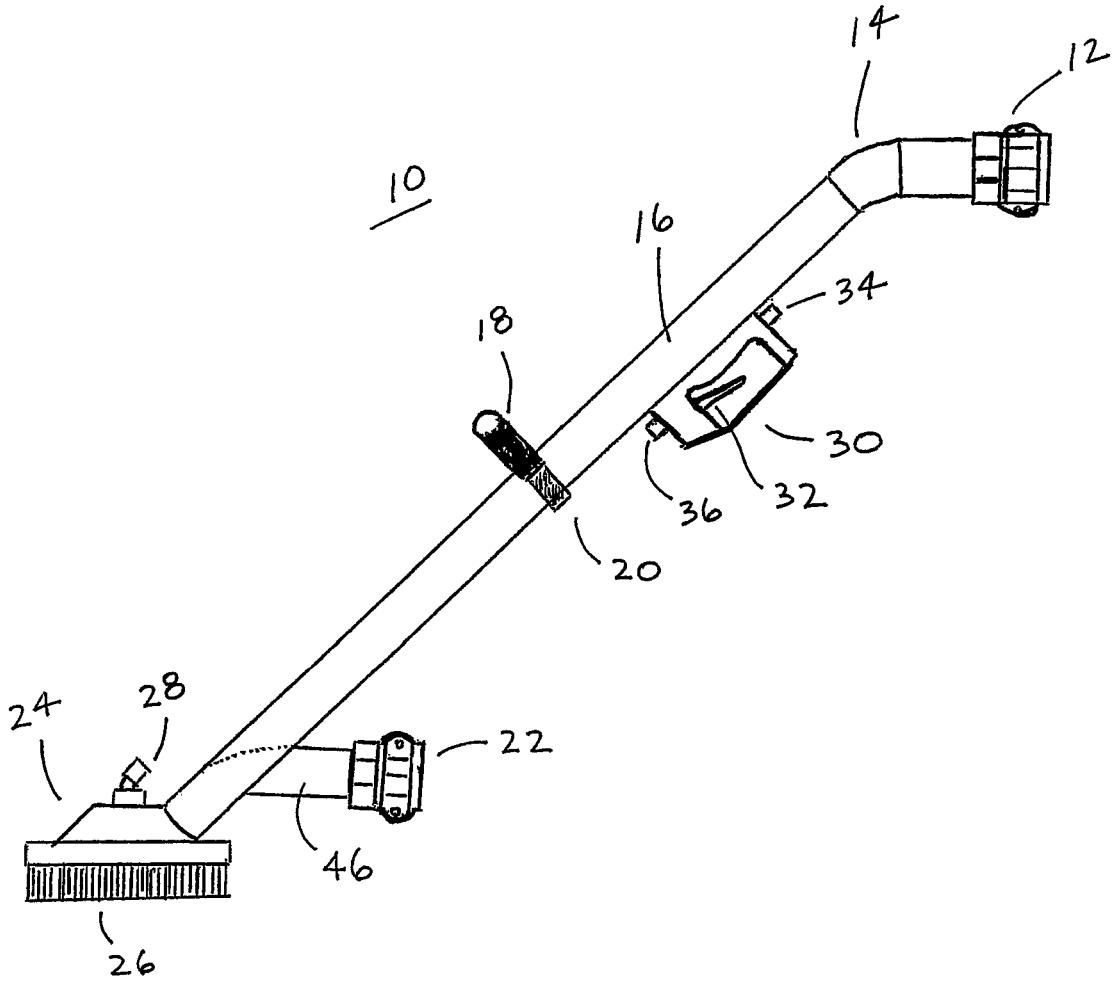
FIG. 2 is a side elevation view of the vacuum attachment tool of FIG. 1.
Figure 3:
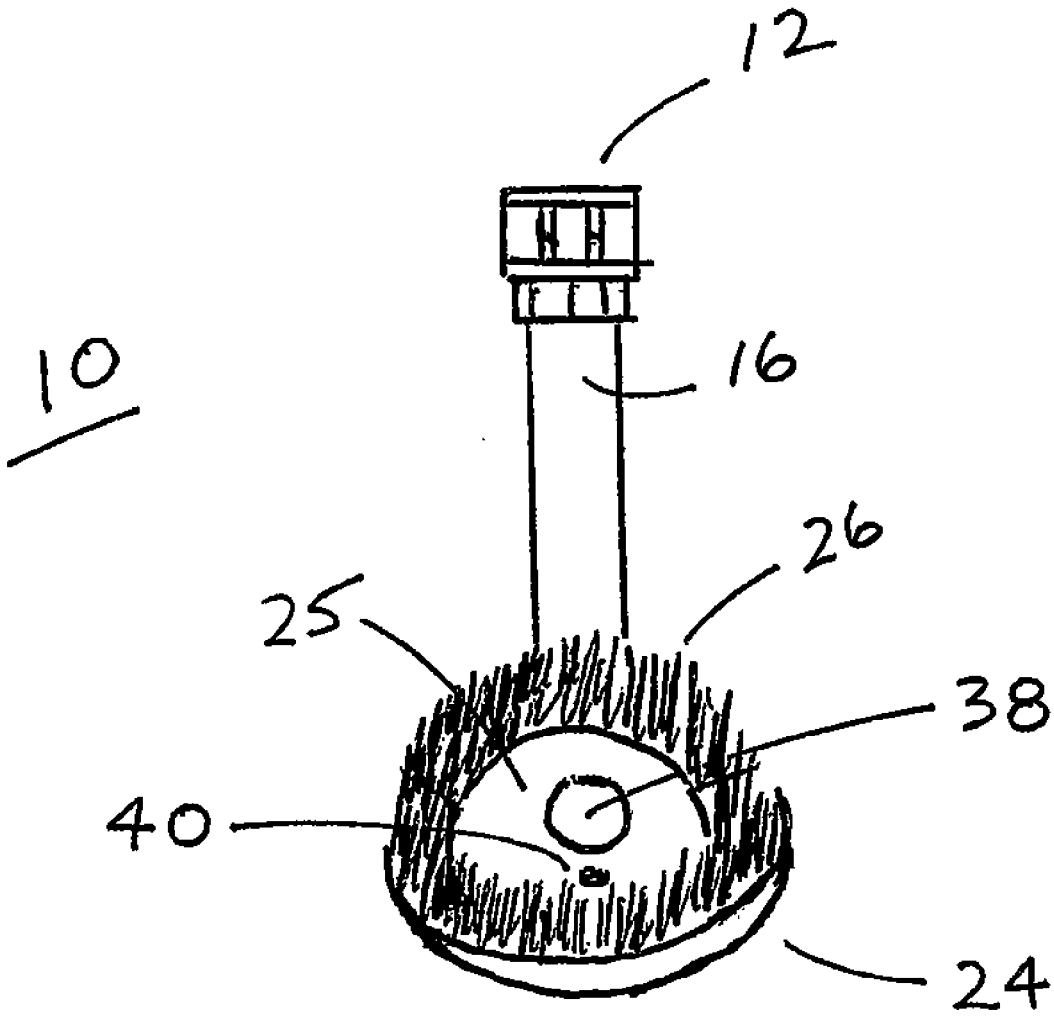
FIG. 3 is a bottom view depicting the brush head of the vacuum attachment tool of FIG. 1.

Referring to FIGS. 1, 2 and 3, representative embodiments of vacuum attachment tool 10 are illustrated. In one embodiment, vacuum attachment tool 10 can comprise main pipe 16 with brush head 24 disposed at a lower end and elbow 14 disposed at an upper end, elbow 14 further comprising vacuum coupler 12 disposed thereon, bottom surface 25 of brush head 24 further comprising vacuum orifice 38 and bristles 26 extending downwardly therefrom. In the illustrated embodiment, brush head 24 is shown to have a circular shape although any suitable shape of brush head can be substituted therefor. Bristles 26 can comprise any natural or man-made fibres suitable for cleaning drilling fluids, solids or produced substances from a drilling rig floor. Bristles 26 can be disposed wholly or partially about the perimeter of brush head 24.

In the illustrated embodiment, pipe 16 and elbow 14 can provide communication therethrough between vacuum coupler 12 and vacuum orifice 38 disposed on brush head 24. In this embodiment, pipe 16 and elbow 14 are shown as having a circular cross-sectional shape although pipe 16 and elbow 14 can have any suitable cross-sectional shape. Furthermore, the illustrated embodiment comprises elbow 14 to provide a handle or grip for an operator to use tool 10. However, the elbow 14 is not a required or necessary element for tool 10.

In operation, attachment tool 10 can be attached to a hose (not shown) connected to a first vacuum system (not shown), vacuum coupler 12 being configured to releasably connect to the vacuum system. When the vacuum system is being operated, fluids, solids, produced substances and/or debris can be drawn into vacuum orifice 38, through pipe 16 and out vacuum coupler 12 to the vacuum system for disposal. Bristles 26 on brush head 24 can enable an operator to use tool 10 for loosening fluids, solids, produced substances or other debris on a surface so that they can be vacuumed up through tool 10 to the vacuum system.

In another embodiment, vacuum attachment tool 10 can comprise vacuum coupler 22 disposed at the lower end of pipe 16 whereby vacuum coupler 22 is in communication with brush head 24 through pipe 46. In this embodiment, a second vacuum hose (not shown) attached to a second vacuum system (not shown) can be connected to vacuum coupler 22 to provide additional suction power for removing fluids, solids, produced substances or debris from the surface. In a further embodiment, and for the purposes of this specifications and the claims herein, vacuum orifice 38 can comprise two or more orifices, all in common communication with vacuum couplers 12 and 22, as well as comprising two or more orifices that are not in common communication with each other and provide separate communication to vacuum couplers 12 and 22, respectively. For the purposes of this specification, the second vacuum system can comprise a separate vacuum system from the first vacuum system or it can comprise a second vacuum hose operatively connected to the first vacuum system.

Referring to FIGS. 2 and 3, another embodiment of tool 10 can further comprise means for dispensing cleaning fluid from brush head 24. In the illustrated embodiment, the means can comprise one or more cleaner orifices 40 disposed on brush head 24, whereby cleaner orifice 40 can be in communication with line coupler 28 disposed on brush head 24. In this embodiment, cleaner orifice 40 is shown disposed on bottom surface 25 of brush head 24 although cleaner orifice 40 can be disposed on any location on brush head that enables cleaning fluid to be dispensed from brush head 24 on the surface being cleaned with tool 10. In embodiments where cleaner orifice 40 is disposed on bottom surface 25, bristles 26 can form a skirt extending downwardly from the perimeter of brush head 24 whereby upon dispensing cleaning fluid under sufficient pressure from cleaner orifice 40 the skirt can provide enough force to raise brush head 24 up and allow it to float or hover on the surface being cleaned.

In embodiments comprising two or more cleaner orifices 40, the orifices can be disposed in a spaced-apart configuration surrounding vacuum orifice 38. In other embodiments, one or more cleaner orifices 40 can be disposed on a leading edge and/or a top surface of brush head 24 and configured so as to dispense cleaning fluid in a generally forward and/or lateral direction from tool 10, that is, away from pipe 16 and onto the surface being cleaned.

In addition, tool 10 can further comprise trigger handle 30 disposed on pipe 16, handle 30 further comprising trigger valve mechanism 32, inlet coupler 34 and outlet coupler 36. A hose (not shown) can be used to connect line coupler 28 to outlet coupler 36 to provide communication therebetween. Another hose (not shown) can be connected to inlet coupler 34 to a source of pressurized cleaning fluid (not shown). In the illustrated embodiment, trigger handle 30 is shown disposed on pipe 16 although it is not necessary or essential that trigger handle 30 is disposed on pipe 16.

In operation, an operator can use tool 10 to apply cleaning fluid to a surface by operating trigger valve mechanism 32 to enable the flow of pressurized cleaning fluid from its source through the hoses and trigger handle 30 to the at least one cleaner orifice 40 through which cleaning fluid can be dispensed onto the surface being cleaned. An operator can use trigger valve mechanism 32 to simply apply cleaning fluid to the surface or in combination with using tool 10 to brush the surface to loosen fluids, solids or produced substances from the surface while vacuuming up fluids, solids or produced substances from the surface. In the illustrated embodiment, trigger valve mechanism 32 is shown as a mechanism similar in appearance and function as a firearm trigger although it should be understood that any suitable valve mechanism adapted for controlling the flow of pressurized cleaning fluid can be substituted therefor.

In other embodiments, the means for dispensing cleaning fluid from brush head 24 can be configured to dispense two or more different cleaning fluids. In such embodiments, the various elements that make up the dispensing means can be multiplied and configured to provide two or more "fluid circuits" to dispense different cleaning fluids. As an example, trigger valve mechanism 32 can be configured to control the flow of steam and a hydrocarbon-based cleaning solvent. The steam can be used to remove ice accumulated on a drilling rig floor during winter drilling operations whereas the cleaning solvent can be used to remove drilling fluids and produced substances. In such configurations, trigger valve mechanism 32 can be configured to either control the flow of two or more cleaning fluids simultaneously in tandem, or to control the flow of the two or more cleaning fluids separately and individually.

In yet another embodiment, tool 10 can further comprise handle 18 that can be adjustably attached to pipe 16 with handle clamp 20. Handle clamp 20 can be any suitable mechanism for clamping a handle to a pipe. By being able to attach handle 18 up or down on pipe 16, handle 18 can be placed on pipe 16 at a comfortable position for an operator.

Figure 4:
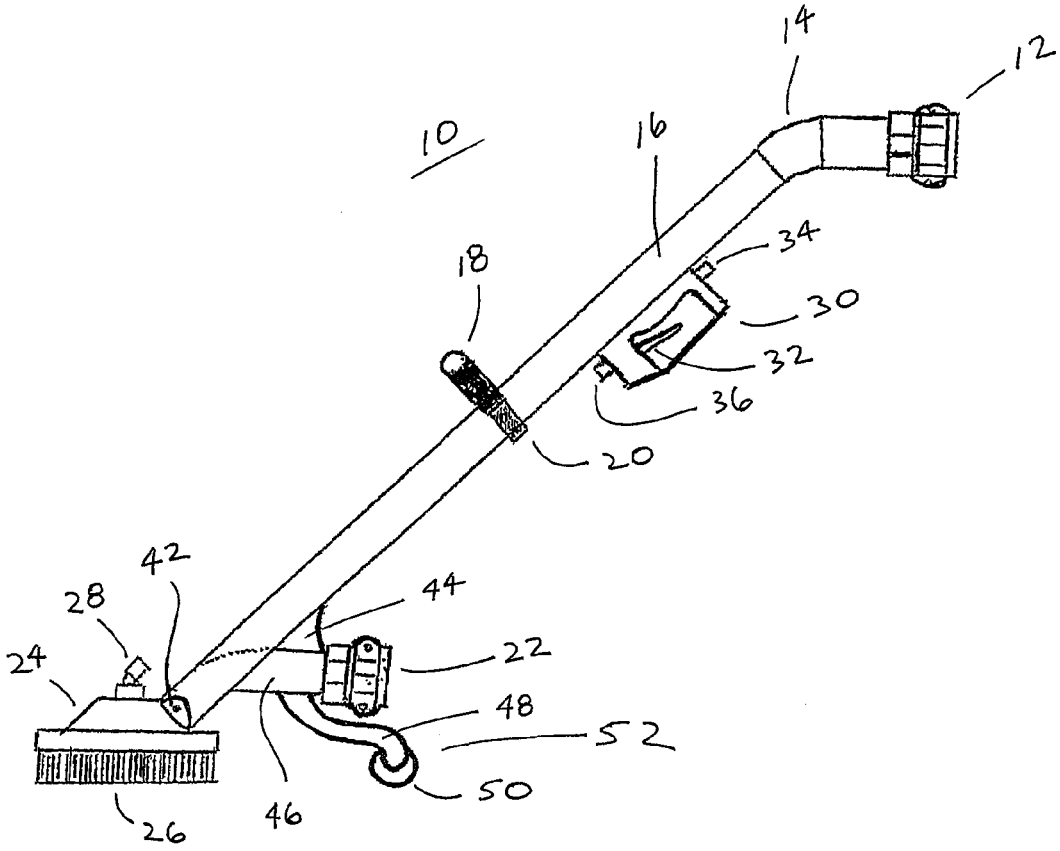
FIG. 4 is a side elevation view of an alternate embodiment of the vacuum attachment tool of FIG. 2.

Referring to FIG. 4, an alternate embodiment of tool 10 is shown. In this embodiment, tool 10 can further comprise swivel joint 42 to pivotally couple brush head 24 to pipe 16. The inclusion of swivel joint 42 can allow an operator to raise or lower pipe 16 relative to brush head 24 when tool 10 is being used to remove solids and fluids from a drilling rig floor. In another embodiment, tool 10 can further comprise pivot wheel assembly 52 to provide further mobility in maneuvering tool 10 on a surface. Pivot wheel assembly 52 can comprise leg 48 disposed on and extending downwardly from pipe 46 of vacuum coupler 22. Wheel 50 can be pivotally attached to leg 48. In a further embodiment, tool 10 can comprise gusset 44 disposed between pipe 16 and pipe 46 to provide support and strength to wheel assembly 52. Although pivot wheel assembly 52 is shown having wheel 50 pivotally attached to leg 48, wheel 50 can be substituted with a ball and socket mechanism disposed on the end of leg 48 to allow tool 10 to be maneuvered in any direction on a surface. In operation, an operator can simply tilt pipe 16 downwards until wheel 50 contacts the surface. In so doing, brush head 24 can be raised off the surface making it easier to move tool 10 to roll on wheel 50 to a desired location on the surface.

Although a few embodiments have been shown and described, it will be appreciated that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. A vacuum attachment tool for use with at least one vacuum system and a source of at least one pressurized cleaning fluid, comprising:

a) a longitudinal pipe having a first vacuum coupler adapted to couple with the at least one vacuum system, the first vacuum coupler disposed at a first end of the pipe, and a brush head disposed at a second end of the pipe, the brush head comprising at least one vacuum orifice disposed on a bottom surface thereof, the pipe providing communication between the first vacuum coupler and the at least one vacuum orifice;

b) bristles disposed on the bottom surface of the brush head;

c) a second vacuum coupler disposed on the pipe, the second vacuum coupler in communication with the at least one vacuum orifice, the second vacuum coupler adapted to couple with the one or more vacuum system; and d) means for dispensing at least one cleaning fluid from the brush head.

2. The tool as set forth in claim 1, wherein the second vacuum coupler is disposed on the pipe near the brush head.

3. The tool as set forth in claim 1, wherein the means for dispensing at least one cleaning fluid further comprises:

a) at least one cleaner orifice disposed on the brush head;

b) at least one line coupler disposed on the brush head, the at least one line coupler in communication with the at least one cleaner orifice;

c) a valve mechanism having at least one inlet and at least one outlet, the valve mechanism adapted for controlling the flow of the at least one cleaning fluid between the at least one inlet and the at least one outlet, the at least one cleaning fluid being provided to the tool under pressure;

d) a first hose operatively connecting the at least one outlet to the at least one line coupler to provide communication therebetween; and e) a second hose operatively connecting the at least one inlet to the source of the pressurized at least one cleaning fluid to provide communication therebetween.

4. The tool as set forth in claim 3, wherein the tool is configured to dispense at least two cleaning fluids from the brush head.

5. The tool as set forth in claim 1, further comprising a pivot wheel assembly.

6. A method for cleaning a surface of fluids and solids, the method comprising the steps of:

a) providing one or more vacuum systems;

b) providing at least one source of pressurized cleaning fluid;

c) providing a vacuum attachment tool, the tool comprising:

i) a longitudinal pipe having a first vacuum coupler adapted to couple with the vacuum system, the first vacuum coupler disposed at a first end of the pipe, and a brush head disposed at a second end of the pipe, the brush head comprising at least one vacuum orifice disposed on a bottom surface thereof, the pipe providing communication between the first vacuum coupler and the at least one vacuum orifice, ii) bristles disposed on the bottom surface of the brush head, iii) a second vacuum coupler disposed on the pipe, the second vacuum coupler in communication with the at least one vacuum orifice, the second vacuum coupler adapted to couple with the one or more vacuum system, and iv) means for dispensing at least one cleaning fluid from the brush head;

d) operatively coupling the tool to the one or more vacuum systems and to the source of the at least one pressurized cleaning fluid;

e) applying at least one cleaning fluid to the surface with the tool; and f) brushing the surface with the brush head whereby the fluids and solids loosened from the surface can be vacuumed through the at least one vacuum orifice to the one or more vacuum systems.

7. The method as set forth in claim 6, wherein the second vacuum coupler is disposed on the pipe near the brush head.

8. The method as set forth in claim 6, wherein the means for dispensing cleaning fluid further comprises:

g) at least one cleaner orifice disposed on the brush head;

h) at least one line coupler disposed on the brush head, the at least one line coupler in communication with the at least one cleaner orifice;

i) a valve mechanism having at least one inlet and at least one outlet, the valve mechanism adapted for controlling the flow of the at least one cleaning fluid between the at least one inlet and the at least one outlet, the at least one cleaning fluid being provided to the tool under pressure;

j) a first hose operatively connecting the at least one outlet to the at least one line coupler to provide communication therebetween; and k) a second hose operatively connecting the at least one inlet to the source of the pressurized at least one cleaning fluid to provide communication therebetween.

9. The method as set forth in claim 8, wherein the tool is configured to dispense at least two cleaning fluids from the brush head.

10. The method as set forth in claim 6, wherein the further comprises a pivot wheel assembly.

* * * * *